US007602375B2

(12) United States Patent
Chui et al.

(10) Patent No.: US 7,602,375 B2
(45) **Date of Patent: *Oct. 13, 2009**

(54) METHOD AND SYSTEM FOR WRITING DATA TO MEMS DISPLAY ELEMENTS

(75) Inventors: Clarence Chui, San Mateo, CA (US); Manish Kothari, Cupertino, CA (US)

(73) Assignee: IDC, LLC, Pleasanton, CA (US)

( * ) Notice: Subject to any disclaimer, the term of this patent is extended or adjusted under 35 U.S.C. 154(b) by 554 days.

This patent is subject to a terminal disclaimer.

(21) Appl. No.: 11/100,762

(22) Filed: Apr. 6, 2005

(65) Prior Publication Data

US 2006/0066559 A1 Mar. 30, 2006

Related U.S. Application Data

(60) Provisional application No. 60/613,483, filed on Sep. 27, 2004.

(51) Int. Cl.
*G09G 3/34* (2006.01)

(52) U.S. Cl. ..... 345/108; 345/107

(58) Field of Classification Search ..... 345/84–89, 345/108, 204, 205, 98, 55, 1.1, 30, 107, 97; 359/201, 204, 198, 288, 290, 462, 464, 291, 359/260, 296, 621, 247, 223, 618; 438/52; 715/768; 349/65, 113; 427/421.1; 455/566; 353/53

See application file for complete search history.

(56) References Cited

U.S. PATENT DOCUMENTS 4,403,248 A 9/1983 te Velde
4,441,791 A 4/1984 Hornbeck
4,459,182 A 7/1984 te Velde
4,482,213 A 11/1984 Piliavin et al.
4,500,171 A 2/1985 Penz et al.
4,519,676 A 5/1985 te Velde
4,566,935 A 1/1986 Hornbeck
4,571,603 A 2/1986 Hornbeck et al.
4,596,992 A 6/1986 Hornbeck
4,615,595 A 10/1986 Hornbeck
4,662,746 A 5/1987 Hornbeck
4,681,403 A 7/1987 te Velde et al.
4,709,995 A 12/1987 Kuribayashi et al.

(Continued)

FOREIGN PATENT DOCUMENTS

EP 0 295 802 12/1988

(Continued)

OTHER PUBLICATIONS

Bains, "Digital Paper Display Technology holds Promise for Portables", CommsDesign EE Times (2000).

(Continued)

*Primary Examiner*—Prabodh M Dharia
(74) *Attorney, Agent, or Firm*—Knobbe Martens Olson & Bear, LLP

(57) ABSTRACT

Charge balanced display data writing methods use write and hold cycles of opposite polarity during selected frame update periods. A release cycle may be provided to reduce the chance that a given display element will become stuck in an actuated state.

22 Claims, 9 Drawing Sheets

U.S. PATENT DOCUMENTS

| | | | | |
|---|---|---|---|---|
| 4,710,732 | A | | 12/1987 | Hornbeck |
| 4,856,863 | A | | 8/1989 | Sampsell et al. |
| 4,954,789 | A | | 9/1990 | Sampsell |
| 4,956,619 | A | | 9/1990 | Hornbeck |
| 4,982,184 | A | | 1/1991 | Kirkwood |
| 5,018,256 | A | | 5/1991 | Hornbeck |
| 5,028,939 | A | | 7/1991 | Hornbeck et al. |
| 5,037,173 | A | | 8/1991 | Sampsell et al. |
| 5,055,833 | A | | 10/1991 | Hehlen et al. |
| 5,061,049 | A | | 10/1991 | Hornbeck |
| 5,078,479 | A | | 1/1992 | Vuilleumier |
| 5,079,544 | A | | 1/1992 | DeMond et al. |
| 5,083,857 | A | | 1/1992 | Hornbeck |
| 5,096,279 | A | | 3/1992 | Hornbeck et al. |
| 5,099,353 | A | | 3/1992 | Hornbeck |
| 5,124,834 | A | | 6/1992 | Cusano et al. |
| 5,142,405 | A | | 8/1992 | Hornbeck |
| 5,162,787 | A | | 11/1992 | Thompson et al. |
| 5,168,406 | A | | 12/1992 | Nelson |
| 5,170,156 | A | | 12/1992 | DeMond et al. |
| 5,172,262 | A | | 12/1992 | Hornbeck |
| 5,179,274 | A | | 1/1993 | Sampsell |
| 5,192,395 | A | | 3/1993 | Boysel et al. |
| 5,192,946 | A | | 3/1993 | Thompson et al. |
| 5,206,629 | A | | 4/1993 | DeMond et al. |
| 5,212,582 | A | | 5/1993 | Nelson |
| 5,214,419 | A | | 5/1993 | DeMond et al. |
| 5,214,420 | A | | 5/1993 | Thompson et al. |
| 5,216,537 | A | | 6/1993 | Hornbeck |
| 5,226,099 | A | | 7/1993 | Mignardi et al. |
| 5,227,900 | A | | 7/1993 | Inaba et al. |
| 5,231,532 | A | | 7/1993 | Magel et al. |
| 5,233,385 | A | | 8/1993 | Sampsell |
| 5,233,456 | A | | 8/1993 | Nelson |
| 5,233,459 | A | | 8/1993 | Bozler et al. |
| 5,254,980 | A | | 10/1993 | Hendrix et al. |
| 5,272,473 | A | | 12/1993 | Thompson et al. |
| 5,278,652 | A | | 1/1994 | Urbanus et al. |
| 5,280,277 | A | | 1/1994 | Hornbeck |
| 5,287,096 | A | | 2/1994 | Thompson et al. |
| 5,296,950 | A | | 3/1994 | Lin et al. |
| 5,305,640 | A | | 4/1994 | Boysel et al. |
| 5,312,513 | A | | 5/1994 | Florence et al. |
| 5,323,002 | A | | 6/1994 | Sampsell et al. |
| 5,325,116 | A | | 6/1994 | Sampsell |
| 5,327,286 | A | | 7/1994 | Sampsell et al. |
| 5,331,454 | A | | 7/1994 | Hornbeck |
| 5,339,116 | A | | 8/1994 | Urbanus et al. |
| 5,365,283 | A | | 11/1994 | Doherty et al. |
| 5,411,769 | A | | 5/1995 | Hornbeck |
| 5,444,566 | A | | 8/1995 | Gale et al. |
| 5,446,479 | A | | 8/1995 | Thompson et al. |
| 5,448,314 | A | | 9/1995 | Heimbuch et al. |
| 5,452,024 | A | | 9/1995 | Sampsell |
| 5,454,906 | A | | 10/1995 | Baker et al. |
| 5,457,493 | A | | 10/1995 | Leddy et al. |
| 5,457,566 | A | | 10/1995 | Sampsell et al. |
| 5,459,602 | A | | 10/1995 | Sampsell |
| 5,461,411 | A | | 10/1995 | Florence et al. |
| 5,489,952 | A | | 2/1996 | Gove et al. |
| 5,497,172 | A | | 3/1996 | Doherty et al. |
| 5,497,197 | A | | 3/1996 | Gove et al. |
| 5,497,262 | A | * | 3/1996 | Kaeriyama ..... 359/223 |
| 5,499,062 | A | | 3/1996 | Urbanus |
| 5,506,597 | A | | 4/1996 | Thompson et al. |
| 5,515,076 | A | | 5/1996 | Thompson et al. |
| 5,517,347 | A | | 5/1996 | Sampsell |
| 5,523,803 | A | | 6/1996 | Urbanus et al. |
| 5,526,051 | A | | 6/1996 | Gove et al. |
| 5,526,172 | A | | 6/1996 | Kanack |
| 5,526,688 | A | | 6/1996 | Boysel et al. |
| 5,535,047 | A | | 7/1996 | Hornbeck |
| 5,548,301 | A | | 8/1996 | Kornher et al. |
| 5,551,293 | A | | 9/1996 | Boysel et al. |
| 5,552,924 | A | | 9/1996 | Tregilgas |
| 5,552,925 | A | | 9/1996 | Worley |
| 5,563,398 | A | | 10/1996 | Sampsell |
| 5,567,334 | A | | 10/1996 | Baker et al. |
| 5,570,135 | A | | 10/1996 | Gove et al. |
| 5,581,272 | A | | 12/1996 | Conner et al. |
| 5,583,688 | A | | 12/1996 | Hornbeck |
| 5,589,852 | A | | 12/1996 | Thompson et al. |
| 5,597,736 | A | | 1/1997 | Sampsell |
| 5,600,383 | A | | 2/1997 | Hornbeck |
| 5,602,671 | A | | 2/1997 | Hornbeck |
| 5,606,441 | A | | 2/1997 | Florence et al. |
| 5,608,468 | A | | 3/1997 | Gove et al. |
| 5,610,438 | A | | 3/1997 | Wallace et al. |
| 5,610,624 | A | | 3/1997 | Bhuva |
| 5,610,625 | A | | 3/1997 | Sampsell |
| 5,619,365 | A | | 4/1997 | Rhoads et al. |
| 5,619,366 | A | | 4/1997 | Rhoads et al. |
| 5,629,790 | A | | 5/1997 | Neukermans et al. |
| 5,633,652 | A | | 5/1997 | Kanbe et al. |
| 5,636,052 | A | | 6/1997 | Arney et al. |
| 5,638,084 | A | | 6/1997 | Kalt |
| 5,638,946 | A | | 6/1997 | Zavracky |
| 5,646,768 | A | | 7/1997 | Kaeriyama |
| 5,650,881 | A | | 7/1997 | Hornbeck |
| 5,654,741 | A | | 8/1997 | Sampsell et al. |
| 5,657,099 | A | | 8/1997 | Doherty et al. |
| 5,659,374 | A | | 8/1997 | Gale, Jr. et al. |
| 5,665,997 | A | | 9/1997 | Weaver et al. |
| 5,726,675 | A | * | 3/1998 | Inoue ..... 345/97 |
| 5,745,193 | A | | 4/1998 | Urbanus et al. |
| 5,745,281 | A | | 4/1998 | Yi et al. |
| 5,754,160 | A | | 5/1998 | Shimizu et al. |
| 5,771,116 | A | | 6/1998 | Miller et al. |
| 5,784,189 | A | | 7/1998 | Bozler et al. |
| 5,784,212 | A | | 7/1998 | Hornbeck |
| 5,808,780 | A | | 9/1998 | McDonald |
| 5,818,095 | A | | 10/1998 | Sampsell |
| 5,828,367 | A | | 10/1998 | Kuga |
| 5,835,255 | A | | 11/1998 | Miles |
| 5,842,088 | A | | 11/1998 | Thompson |
| 5,883,684 | A | * | 3/1999 | Millikan et al. ..... 349/65 |
| 5,912,758 | A | | 6/1999 | Knipe et al. |
| 5,943,158 | A | | 8/1999 | Ford et al. |
| 5,959,763 | A | | 9/1999 | Bozler et al. |
| 5,986,796 | A | * | 11/1999 | Miles ..... 359/260 |
| 6,028,690 | A | | 2/2000 | Carter et al. |
| 6,038,056 | A | | 3/2000 | Florence et al. |
| 6,040,937 | A | | 3/2000 | Miles |
| 6,049,317 | A | | 4/2000 | Thompson et al. |
| 6,055,090 | A | * | 4/2000 | Miles ..... 359/291 |
| 6,061,075 | A | | 5/2000 | Nelson et al. |
| 6,099,132 | A | | 8/2000 | Kaeriyama |
| 6,100,872 | A | | 8/2000 | Aratani et al. |
| 6,113,239 | A | | 9/2000 | Sampsell et al. |
| 6,147,790 | A | | 11/2000 | Meier et al. |
| 6,151,167 | A | * | 11/2000 | Melville ..... 359/618 |
| 6,160,833 | A | | 12/2000 | Floyd et al. |
| 6,180,428 | B1 | | 1/2001 | Peeters et al. |
| 6,201,633 | B1 | * | 3/2001 | Peeters et al. ..... 359/296 |
| 6,232,936 | B1 | | 5/2001 | Gove et al. |
| 6,245,590 | B1 | * | 6/2001 | Wine et al. ..... 438/52 |
| 6,282,010 | B1 | | 8/2001 | Sulzbach et al. |
| 6,295,154 | B1 | | 9/2001 | Laor et al. |
| 6,323,982 | B1 | | 11/2001 | Hornbeck |
| 6,324,007 | B1 | * | 11/2001 | Melville ..... 359/618 |
| 6,327,071 | B1 | * | 12/2001 | Kimura ..... 359/291 |
| 6,356,254 | B1 | | 3/2002 | Kimura |
| 6,362,912 | B1 | * | 3/2002 | Lewis et al. ..... 359/204 |
| 6,433,907 | B1 | * | 8/2002 | Lippert et al. ..... 359/201 |

| | | | | |
|---|---|---|---|---|
| 6,447,126 | B1 | 9/2002 | Hornbeck | |
| 6,465,355 | B1 | 10/2002 | Horsley | |
| 6,466,358 | B2 | 10/2002 | Tew | |
| 6,473,274 | B1 | 10/2002 | Maimone et al. | |
| 6,480,177 | B2 | 11/2002 | Doherty et al. | |
| 6,496,122 | B2 | 12/2002 | Sampsell | |
| 6,507,330 | B1 | 1/2003 | Handschy et al. | |
| 6,507,331 | B1 | 1/2003 | Schlangen et al. | |
| 6,522,794 | B1 * | 2/2003 | Bischel et al. | 385/4 |
| 6,543,286 | B2 | 4/2003 | Garverick et al. | |
| 6,545,335 | B1 | 4/2003 | Chua et al. | |
| 6,548,908 | B2 | 4/2003 | Chua et al. | |
| 6,549,338 | B1 | 4/2003 | Wolverton et al. | |
| 6,552,840 | B2 | 4/2003 | Knipe | |
| 6,574,033 | B1 | 6/2003 | Chui et al. | |
| 6,589,625 | B1 | 7/2003 | Kothari et al. | |
| 6,600,201 | B2 | 7/2003 | Hartwell et al. | |
| 6,606,175 | B1 | 8/2003 | Sampsell et al. | |
| 6,625,047 | B2 | 9/2003 | Coleman, Jr. | |
| 6,630,786 | B2 | 10/2003 | Cummings et al. | |
| 6,632,698 | B2 | 10/2003 | Ives | |
| 6,636,187 | B2 | 10/2003 | Tajima et al. | |
| 6,643,069 | B2 | 11/2003 | Dewald | |
| 6,650,455 | B2 | 11/2003 | Miles | |
| 6,666,561 | B1 | 12/2003 | Blakley | |
| 6,674,090 | B1 | 1/2004 | Chua et al. | |
| 6,674,562 | B1 | 1/2004 | Miles | |
| 6,680,792 | B2 | 1/2004 | Miles | |
| 6,710,908 | B2 | 3/2004 | Miles et al. | |
| 6,741,377 | B2 | 5/2004 | Miles | |
| 6,741,384 | B1 | 5/2004 | Martin et al. | |
| 6,741,503 | B1 | 5/2004 | Farris et al. | |
| 6,747,785 | B2 | 6/2004 | Chen et al. | |
| 6,762,873 | B1 | 7/2004 | Coker et al. | |
| 6,775,047 | B1 * | 8/2004 | Leung et al. | 359/290 |
| 6,775,174 | B2 | 8/2004 | Huffman et al. | |
| 6,778,155 | B2 | 8/2004 | Doherty et al. | |
| 6,792,293 | B1 * | 9/2004 | Awan et al. | 455/566 |
| 6,794,119 | B2 | 9/2004 | Miles | |
| 6,811,267 | B1 | 11/2004 | Allen et al. | |
| 6,819,469 | B1 | 11/2004 | Koba | |
| 6,822,628 | B2 | 11/2004 | Dunphy et al. | |
| 6,829,132 | B2 | 12/2004 | Martin et al. | |
| 6,853,129 | B1 | 2/2005 | Cummings et al. | |
| 6,853,418 | B2 * | 2/2005 | Suzuki et al. | 349/113 |
| 6,855,610 | B2 | 2/2005 | Tung et al. | |
| 6,859,218 | B1 | 2/2005 | Luman et al. | |
| 6,861,277 | B1 | 3/2005 | Monroe et al. | |
| 6,862,022 | B2 | 3/2005 | Slupe | |
| 6,862,029 | B1 | 3/2005 | D'Souza et al. | |
| 6,862,141 | B2 * | 3/2005 | Olczak | 359/621 |
| 6,867,896 | B2 * | 3/2005 | Miles | 359/290 |
| 6,870,581 | B2 | 3/2005 | Li et al. | |
| 6,972,881 | B1 * | 12/2005 | Bassetti | 359/198 |
| 7,034,783 | B2 | 4/2006 | Gates et al. | |
| 7,072,093 | B2 * | 7/2006 | Piehl et al. | 359/290 |
| 7,110,158 | B2 * | 9/2006 | Miles | 359/291 |
| 7,123,216 | B1 | 10/2006 | Miles | |
| 7,161,728 | B2 * | 1/2007 | Sampsell et al. | 359/291 |
| 7,291,363 | B2 * | 11/2007 | Miller | 427/421.1 |
| 7,366,393 | B2 * | 4/2008 | Cassarly et al. | 385/146 |
| 7,389,476 | B2 * | 6/2008 | Senda et al. | 715/768 |
| 2001/0003487 | A1 | 6/2001 | Miles | |
| 2001/0026250 | A1 | 10/2001 | Inoue et al. | |
| 2001/0034075 | A1 | 10/2001 | Onoya | |
| 2002/0012159 | A1 | 1/2002 | Tew | |
| 2002/0015215 | A1 | 2/2002 | Miles | |
| 2002/0024711 | A1 * | 2/2002 | Miles | 359/247 |
| 2002/0075555 | A1 | 6/2002 | Miles | |
| 2002/0093722 | A1 | 7/2002 | Chan et al. | |
| 2002/0101769 | A1 | 8/2002 | Garverick et al. | |
| 2002/0126364 | A1 | 9/2002 | Miles | |
| 2002/0190940 | A1 * | 12/2002 | Itoh et al. | 345/87 |
| 2003/0043157 | A1 | 3/2003 | Miles | |
| 2003/0072070 | A1 | 4/2003 | Miles | |
| 2003/0112507 | A1 * | 6/2003 | Divelbiss et al. | 359/464 |
| 2003/0122773 | A1 | 7/2003 | Washio et al. | |
| 2003/0123125 | A1 * | 7/2003 | Little | 359/290 |
| 2003/0137215 | A1 | 7/2003 | Cabuz | |
| 2003/0137521 | A1 | 7/2003 | Zehner et al. | |
| 2003/0202264 | A1 | 10/2003 | Weber et al. | |
| 2003/0202265 | A1 | 10/2003 | Reboa et al. | |
| 2003/0202266 | A1 | 10/2003 | Ring et al. | |
| 2004/0051929 | A1 | 3/2004 | Sampsell et al. | |
| 2004/0058532 | A1 | 3/2004 | Miles et al. | |
| 2004/0080807 | A1 | 4/2004 | Chen et al. | |
| 2004/0145049 | A1 | 7/2004 | McKinnell et al. | |
| 2004/0145553 | A1 | 7/2004 | Sala et al. | |
| 2004/0147056 | A1 | 7/2004 | McKinnell et al. | |
| 2004/0160143 | A1 | 8/2004 | Shreeve et al. | |
| 2004/0174583 | A1 | 9/2004 | Chen et al. | |
| 2004/0179281 | A1 | 9/2004 | Reboa | |
| 2004/0212026 | A1 | 10/2004 | Van Brocklin et al. | |
| 2004/0217378 | A1 | 11/2004 | Martin et al. | |
| 2004/0217919 | A1 | 11/2004 | Piehl et al. | |
| 2004/0218251 | A1 | 11/2004 | Piehl et al. | |
| 2004/0218334 | A1 | 11/2004 | Martin et al. | |
| 2004/0218341 | A1 | 11/2004 | Martin et al. | |
| 2004/0227493 | A1 | 11/2004 | Van Brocklin et al. | |
| 2004/0240032 | A1 | 12/2004 | Miles | |
| 2004/0240138 | A1 | 12/2004 | Martin et al. | |
| 2004/0245588 | A1 | 12/2004 | Nikkel et al. | |
| 2004/0263502 | A1 * | 12/2004 | Dallas et al. | 345/204 |
| 2004/0263944 | A1 | 12/2004 | Miles et al. | |
| 2005/0001828 | A1 | 1/2005 | Martin et al. | |
| 2005/0024301 | A1 | 2/2005 | Funston | |
| 2005/0038950 | A1 | 2/2005 | Adelmann | |
| 2005/0057442 | A1 | 3/2005 | Way | |
| 2005/0068583 | A1 | 3/2005 | Gutkowski et al. | |
| 2005/0069209 | A1 | 3/2005 | Damera-Venkata et al. | |
| 2005/0174340 | A1 * | 8/2005 | Jones | 345/204 |
| 2005/0264472 | A1 * | 12/2005 | Rast | 345/30 |
| 2006/0044246 | A1 | 3/2006 | Mignard | |
| 2006/0044291 | A1 * | 3/2006 | Willis | 345/204 |
| 2006/0044523 | A1 * | 3/2006 | Teijido et al. | 353/53 |
| 2006/0056000 | A1 | 3/2006 | Mignard | |
| 2006/0057754 | A1 * | 3/2006 | Cummings | 438/48 |
| 2007/0285385 | A1 * | 12/2007 | Albert et al. | 345/107 |

FOREIGN PATENT DOCUMENTS

| | | | |
|---|---|---|---|
| EP | 0 300 754 | | 1/1989 |
| EP | 0 667 548 | A1 | 8/1995 |
| EP | 0 911 794 | | 4/1999 |
| EP | 1 239 448 | | 9/2002 |
| EP | 1 280 129 | | 1/2003 |
| EP | 1 414 011 | | 4/2004 |
| WO | WO 95/30924 | | 11/1995 |
| WO | WO 97/17628 | | 5/1997 |
| WO | WO 99/52006 | A3 | 10/1999 |
| WO | WO 02/089103 | | 11/2002 |
| WO | WO 03/007049 | A1 | 1/2003 |
| WO | WO 03/069413 | A1 | 8/2003 |
| WO | WO 03/073151 | A1 | 9/2003 |
| WO | WO 03/079323 | | 9/2003 |
| WO | WO 2004/006003 | A1 | 1/2004 |
| WO | WO 2004/026757 | A2 | 4/2004 |
| WO | WO 2004/054088 | | 6/2004 |

OTHER PUBLICATIONS

Lieberman, "MEMS Display Looks to give PDAs Sharper Image" EE Times (2004).

Lieberman, "Microbridges at heart of new MEMS displays" EE Times (2004).

Partial Search Report dated May 7, 2008 for European App. No. 05255639.6.

Extended Search Report dated Aug. 11, 2008 for European App. No. 05255639.6.
Office Action dated Dec. 11, 2007 in U.S. Appl. No. 11/159,073.
Office Action dated Jun. 15, 2007 in U.S. Appl. No. 11/159,073.
Office Action dated Mar. 10, 2008 in U.S. Appl. No. 11/159,073.
Office Action dated Sep. 18, 2008 in U.S. Appl. No. 11/159,073.
ISR and WO for PCT/US05/029796 filed Aug. 23, 2005.
IPRP for PCT/US05/029796 filed Aug. 23, 2005.
Office Action dated Jun. 20, 2008 in Chinese App. No. 200580028766.X.
Office Action dated Oct. 8, 2008 in U.S. Appl. No. 11/234,061.
Office Action dated May 9, 2008 in Chinese App. No. 200510103441.5.
Chen et al., Low peak current driving scheme for passive matrix-OLED, SID International Symposium Digest of Technical Papers, May 2003, pp. 504-507.
Miles, MEMS-based interferometric modulator for display applications, Part of the SPIE Conference on Micromachined Devices and Components, vol. 3876, pp. 20-28 (1999).
Miles et al., 5.3: Digital Paper™: Reflective displays using interferometric modulation, SID Digest, vol. XXXI, 2000 pp. 32-35.

* cited by examiner

| | | Column Output Signals | |
|---|---|---|---|
| | | $+V_{bias}$ | $-V_{bias}$ |
| Row Output Signals | 0 | Stable | Stable |
| | $+\Delta V$ | Release | Actuate |
| | $-\Delta V$ | Actuate | Release |

METHOD AND SYSTEM FOR WRITING DATA TO MEMS DISPLAY ELEMENTS

CROSS REFERENCE TO RELATED APPLICATIONS

This application claims priority under 35 U.S.C. Section 119(e) to U.S. Provisional Application 60/613,483, entitled Method and Device for Driving Interferometric Modulators, and filed on Sep. 27, 2004. The entire disclosure of this application is hereby incorporated by reference in its entirety.

BACKGROUND

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. An interferometric modulator may comprise a pair of conductive plates, one or both of which may be transparent and/or reflective in whole or part and capable of relative motion upon application of an appropriate electrical signal. One plate may comprise a stationary layer deposited on a substrate, the other plate may comprise a metallic membrane separated from the stationary layer by an air gap. Such devices have a wide range of applications, and it would be beneficial in the art to utilize and/or modify the characteristics of these types of devices so that their features can be exploited in improving existing products and creating new products that have not yet been developed.

SUMMARY

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

In one embodiment, a method of actuating a MEMS display element is provided, wherein the MEMS display element comprises a portion of an array of MEMS display elements. The method includes writing display data to the MEMS display element with a potential difference of a first polarity during a first portion of a display write process, and re-writing the display data to the MEMS display element with a potential difference having a polarity opposite the first polarity during a second portion of the display write process. Subsequently, a first bias potential having the first polarity is applied to the MEMS display element during a third portion of the display write process and a second bias potential having the opposite polarity is applied to the MEMS display element during a fourth portion of the display write process.

In another embodiment, a method of maintaining a frame of display data on an array of MEMS display elements includes alternately applying approximately equal bias voltages of opposite polarities to the MEMS display elements for periods of time defined at least in part by the inverse of a rate at which frames of display data are received by a display system. Each period of time may be substantially equal to 1/(2f) or 1/(4f), wherein f is a defined frequency of frame refresh cycles.

In another embodiment, a method of writing frames of display data to an array of MEMS display elements at a rate of one frame per defined frame update period includes writing display data to the MEMS display elements, wherein the writing takes less than the frame update period and applying a series of bias potentials of alternating polarity to the MEMS display elements for the remainder of the frame update period.

Display devices are also provided. In one such embodiment, a MEMS display device is configured to display images at a frame update rate, the frame update rate defining a frame update period. The display device includes row and column driver circuitry configured to apply a polarity balanced sequence of bias voltages to substantially all columns of a MEMS display array for portions of at least one frame update period, wherein the portions are defined by a time remaining between completing a frame write process for a first frame, and beginning a frame write process for a next subsequent frame.

DETAILED DESCRIPTION OF PREFERRED EMBODIMENTS

The following detailed description is directed to certain specific embodiments of the invention. However, the invention can be embodied in a multitude of different ways. In this description, reference is made to the drawings wherein like parts are designated with like numerals throughout. As will be apparent from the following description, the invention may be implemented in any device that is configured to display an image, whether in motion (e.g., video) or stationary (e.g., still image), and whether textual or pictorial. More particularly, it is contemplated that the invention may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Figure 1:
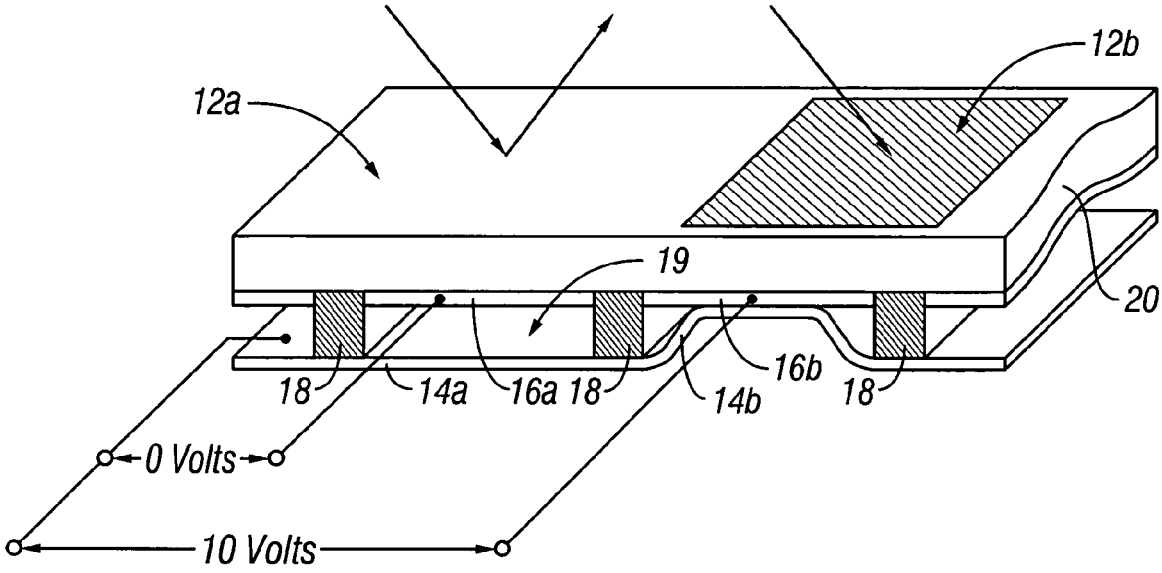
FIG. 1 is an isometric view depicting a portion of one embodiment of an interferometric modulator display in which a movable reflective layer of a first interferometric modulator is in a released position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the released state, the movable layer is positioned at a relatively large distance from a fixed partially reflective layer. In the second position, the movable layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable and highly reflective layer 14*a* is illustrated in a released position at a predetermined distance from a fixed partially reflective layer 16*a*. In the interferometric modulator 12*b* on the right, the movable highly reflective layer 14*b* is illustrated in an actuated position adjacent to the fixed partially reflective layer 16*b*.

The fixed layers 16*a*, 16*b* are electrically conductive, partially transparent and partially reflective, and may be fabricated, for example, by depositing one or more layers each of chromium and indium-tin-oxide onto a transparent substrate 20. The layers are patterned into parallel strips, and may form row electrodes in a display device as described further below. The movable layers 14*a*, 14*b* may be formed as a series of parallel strips of a deposited metal layer or layers (orthogonal to the row electrodes 16*a*, 16*b*) deposited on top of posts 18 and an intervening sacrificial material deposited between the posts 18. When the sacrificial material is etched away, the deformable metal layers are separated from the fixed metal layers by a defined air gap 19. A highly conductive and reflective material such as aluminum may be used for the deformable layers, and these strips may form column electrodes in a display device.

With no applied voltage, the cavity 19 remains between the layers 14*a*, 16*a* and the deformable layer is in a mechanically relaxed state as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable layer is deformed and is forced against the fixed layer (a dielectric material which is not illustrated in this Figure may be deposited on the fixed layer to prevent shorting and control the separation distance) as illustrated by the pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

Figure 2:
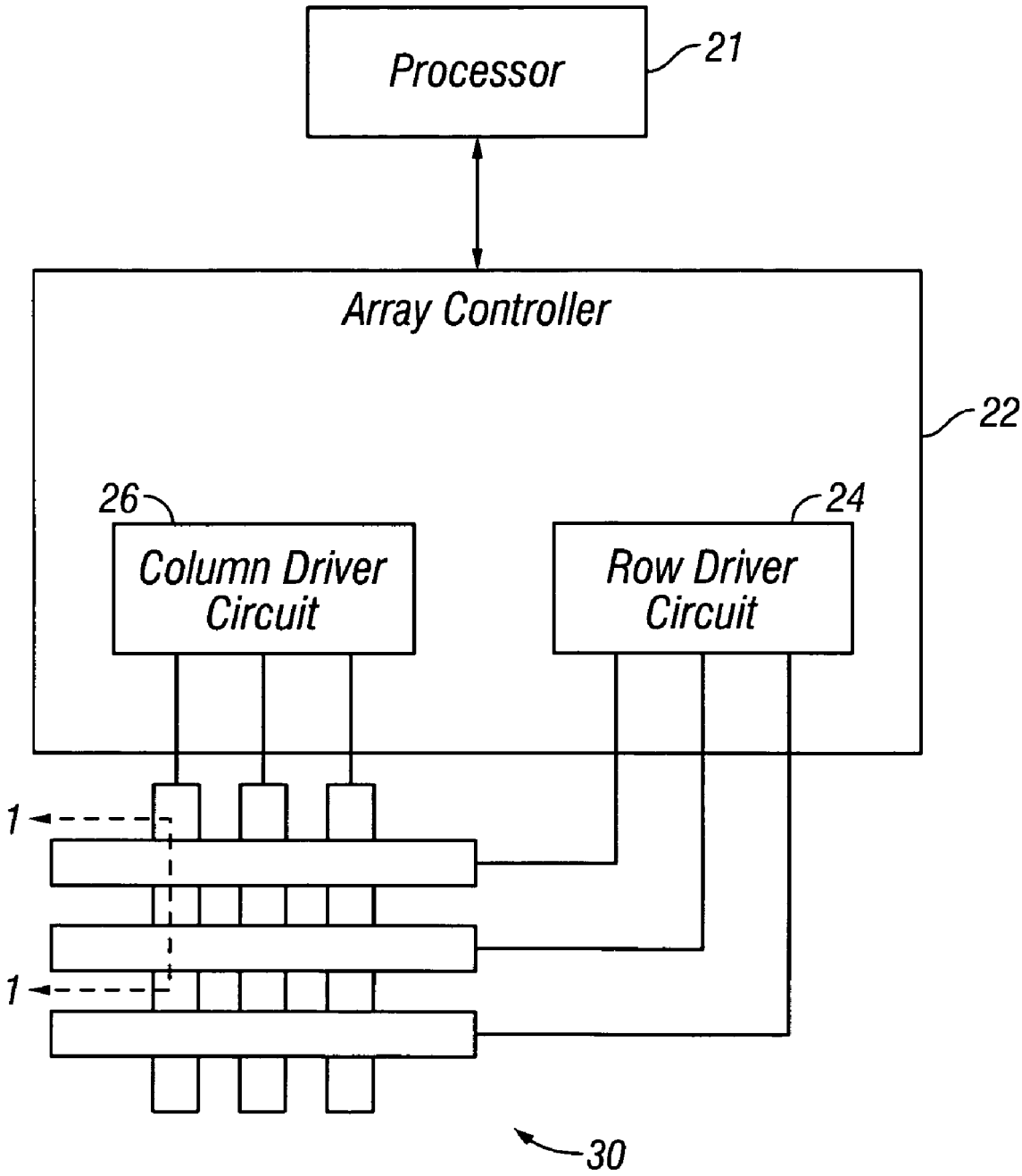
FIG. 2 is a system block diagram illustrating one embodiment of an electronic device incorporating a 3×3 interferometric modulator display.

FIGS. 2 through 5 illustrate one exemplary process and system for using an array of interferometric modulators in a display application. FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array controller 22. In one embodiment, the array controller 22 includes a row driver circuit 24 and a column driver circuit 26 that provide signals to a pixel array 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the released state to the actuated state. However, when the voltage is reduced from that value, the movable layer maintains its state as the voltage drops back below 10 volts. In the exemplary embodiment of FIG. 3, the movable layer does not release completely until the voltage drops below 2 volts. There is thus a range of voltage, about 3 to 7 V in the example illustrated in FIG. 3, where there exists a window of applied voltage within which the device is stable in either the released or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be released are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or released pre-existing state. Since each pixel of the interferometric modulator, whether in the actuated or released state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
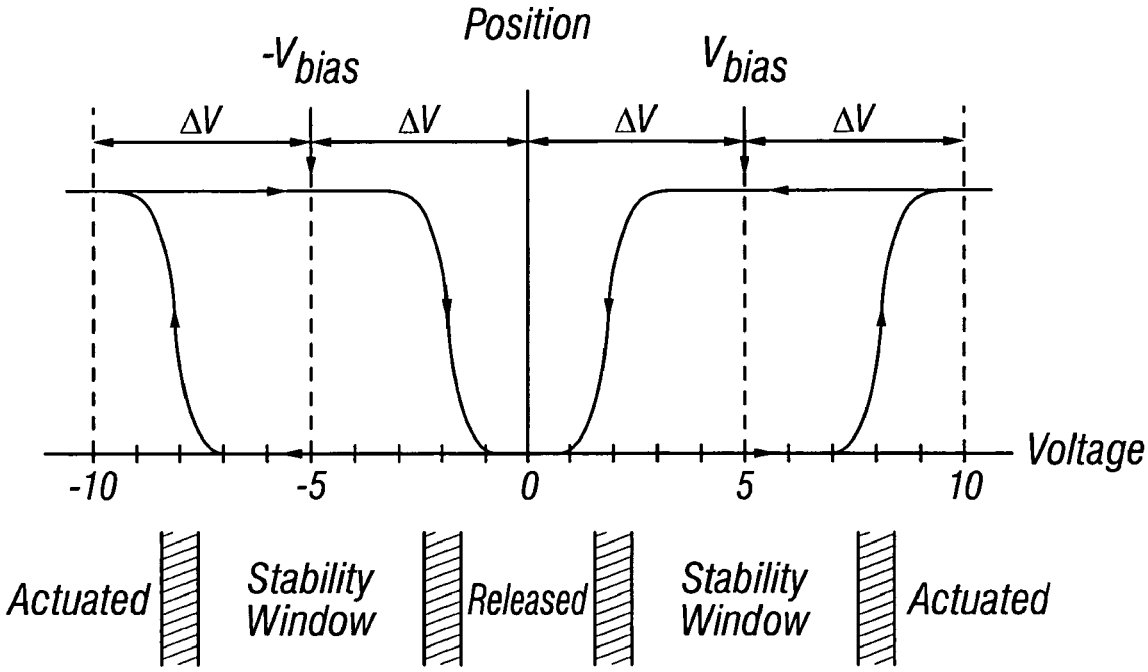
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIGS. 4 and 5 illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Releasing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
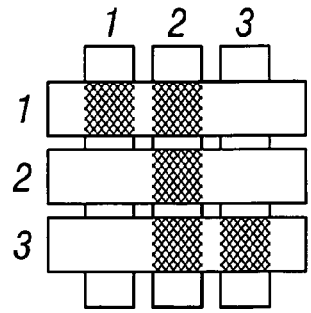
FIGS. 5A and 5B illustrate one exemplary timing diagram for row and column signals that may be used to write a frame of display data to the 3×3 interferometric modulator display of FIG. 2.
Figure 5B:
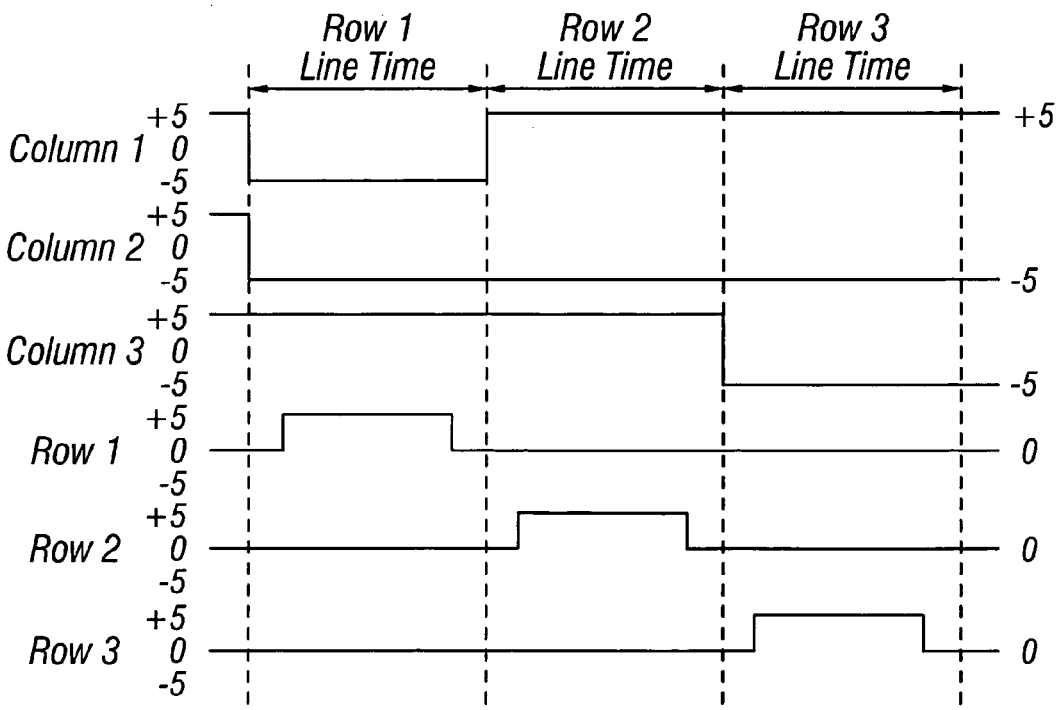

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or released states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and releases the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and release pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the present invention.

Figure 6A:
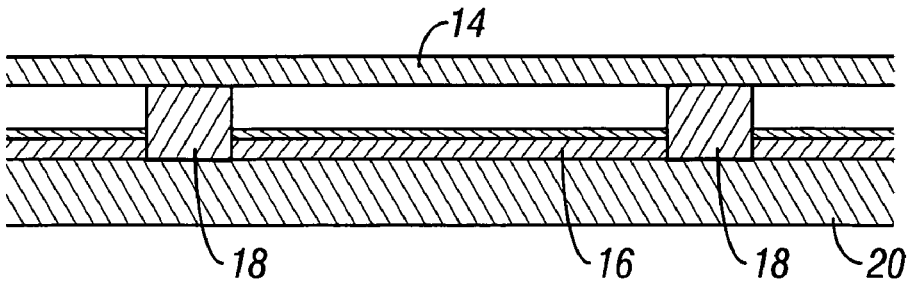
FIG. 6A is a cross section of the device of FIG. 1.
Figure 6B:
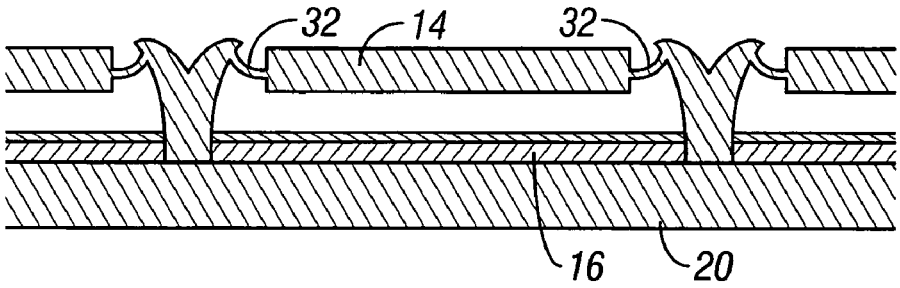
FIG. 6B is a cross section of an alternative embodiment of an interferometric modulator.
Figure 6C:
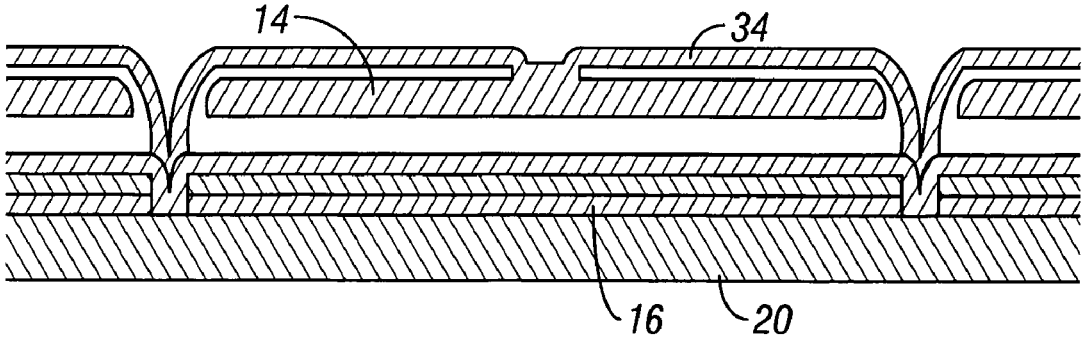
FIG. 6C is a cross section of another alternative embodiment of an interferometric modulator.

The details of the structure of interferometric modulators that operate in accordance with the principles set forth above may vary widely. For example, FIGS. 6A-6C illustrate three different embodiments of the moving mirror structure. FIG. 6A is a cross section of the embodiment of FIG. 1, where a strip of metal material 14 is deposited on orthogonally extending supports 18. In FIG. 6B, the moveable reflective material 14 is attached to supports at the corners only, on tethers 32. In FIG. 6C, the moveable reflective material 14 is suspended from a deformable layer 34. This embodiment has benefits because the structural design and materials used for the reflective material 14 can be optimized with respect to the optical properties, and the structural design and materials used for the deformable layer 34 can be optimized with respect to desired mechanical properties. The production of various types of interferometric devices is described in a variety of published documents, including, for example, U.S. Published Application 2004/0051929. A wide variety of well known techniques may be used to produce the above described structures involving a series of material deposition, patterning, and etching steps.

It is one aspect of the above described devices that charge can build on the dielectric between the layers of the device, especially when the devices are actuated and held in the actuated state by an electric field that is always in the same direction. For example, if the moving layer is always at a higher potential relative to the fixed layer when the device is actuated by potentials having a magnitude larger than the outer threshold of stability, a slowly increasing charge buildup on the dielectric between the layers can begin to shift the hysteresis curve for the device. This is undesirable as it causes display performance to change over time, and in different ways for different pixels that are actuated in different ways over time. As can be seen in the example of FIG. 5B, a given pixel sees a 10 volt difference during actuation, and every time in this example, the row electrode is at a 10 V higher potential than the column electrode. During actuation, the electric field between the plates therefore always points in one direction, from the row electrode toward the column electrode.

This problem can be reduced by actuating the MEMS display elements with a potential difference of a first polarity during a first portion of the display write process, and actuating the MEMS display elements with a potential difference having a polarity opposite the first polarity during a second portion of the display write process. This basic principle is illustrated in FIGS. 7-10.

Figure 7:
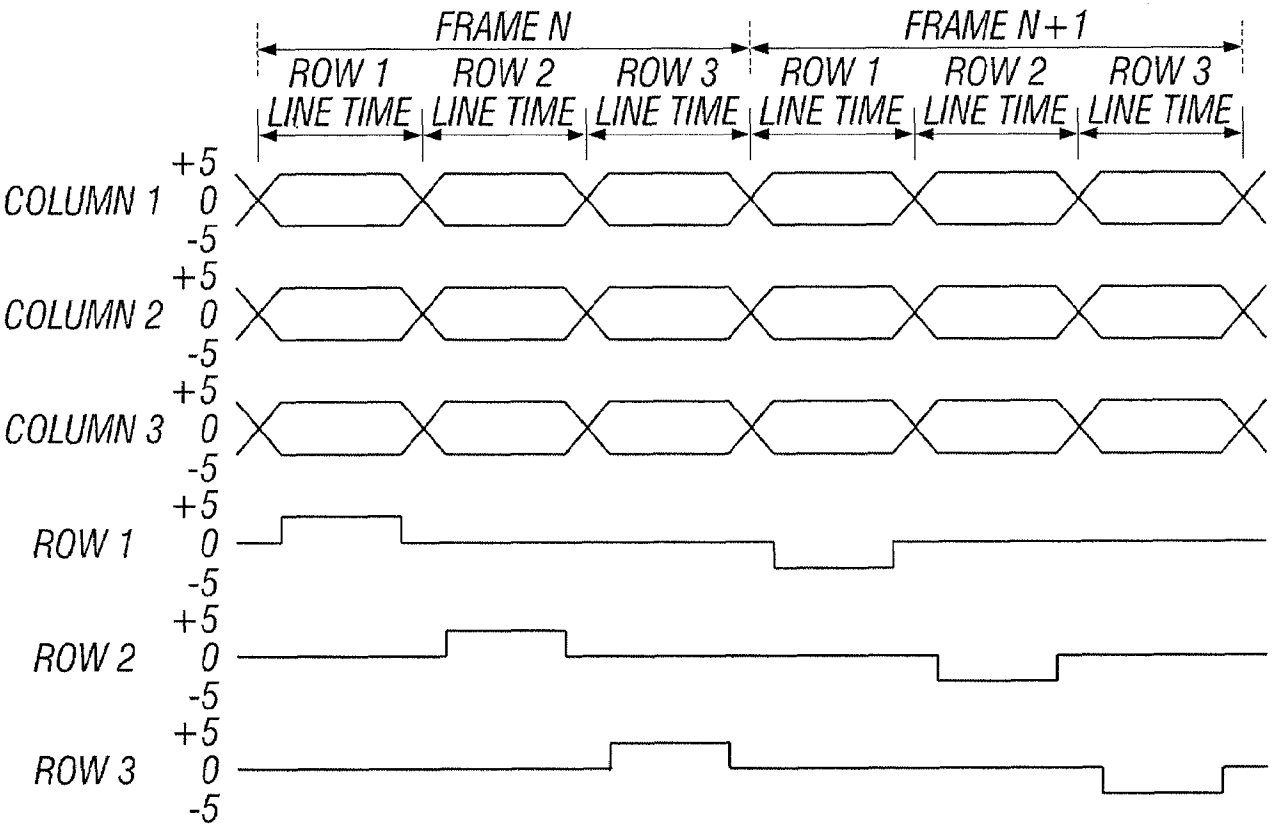
FIG. 7 is a timing diagram illustrating application of opposite write polarities to different frames of display data.

In FIG. 7, two frames of display data are written in sequence, frame N and frame N+1. In this Figure, the data for the columns goes valid for row 1 (i.e., either +5 or −5 depending on the desired state of the pixels in row 1) during the row 1 line time, valid for row 2 during the row 2 line time, and valid for row 3 during the row 3 line time. Frame N is written as shown in FIG. 5B, which will be termed positive polarity herein, with the row electrode 10 V above the column electrode during MEMS device actuation. During actuation, the column electrode may be at −5 V, and the scan voltage on the row is +5 V in this example. The actuation and release of display elements for Frame N is thus performed according to the center row of FIG. 4 above.

Frame N+1 is written in accordance with the lowermost row of FIG. 4. For Frame N+1, the scan voltage is −5 V, and the column voltage is set to +5 V to actuate, and −5 V to release. Thus, in Frame N+1, the column voltage is 10 V above the row voltage, termed a negative polarity herein. As the display is continually refreshed and/or updated, the polarity can be alternated between frames, with Frame N+2 being written in the same manner as Frame N, Frame N+3 written in the same manner as Frame N+1, and so on. In this way, actuation of pixels takes place in both polarities. In embodiments following this principle, potentials of opposite polarities are respectively applied to a given MEMS element at defined times and for defined time durations that depend on the rate at which image data is written to MEMS elements of the array, and the opposite potential differences are each applied an approximately equal amount of time over a given period of display use. This helps reduce charge buildup on the dielectric over time.

A wide variety of modifications of this scheme can be implemented. For example, Frame N and Frame N+1 can comprise different display data. Alternatively, it can be the same display data written twice to the array with opposite polarities. One specific embodiment wherein the same data is written twice with opposite polarity signals is illustrated in additional detail in FIG. 8.

In this Figure, Frame N and N+1 update periods are illustrated. These update periods are typically the inverse of a selected frame update rate that is defined by the rate at which new frames of display data are received by the display system. This rate may, for example, be 15 Hz, 30 Hz, or another frequency depending on the nature of the image data being displayed.

Figure 8:
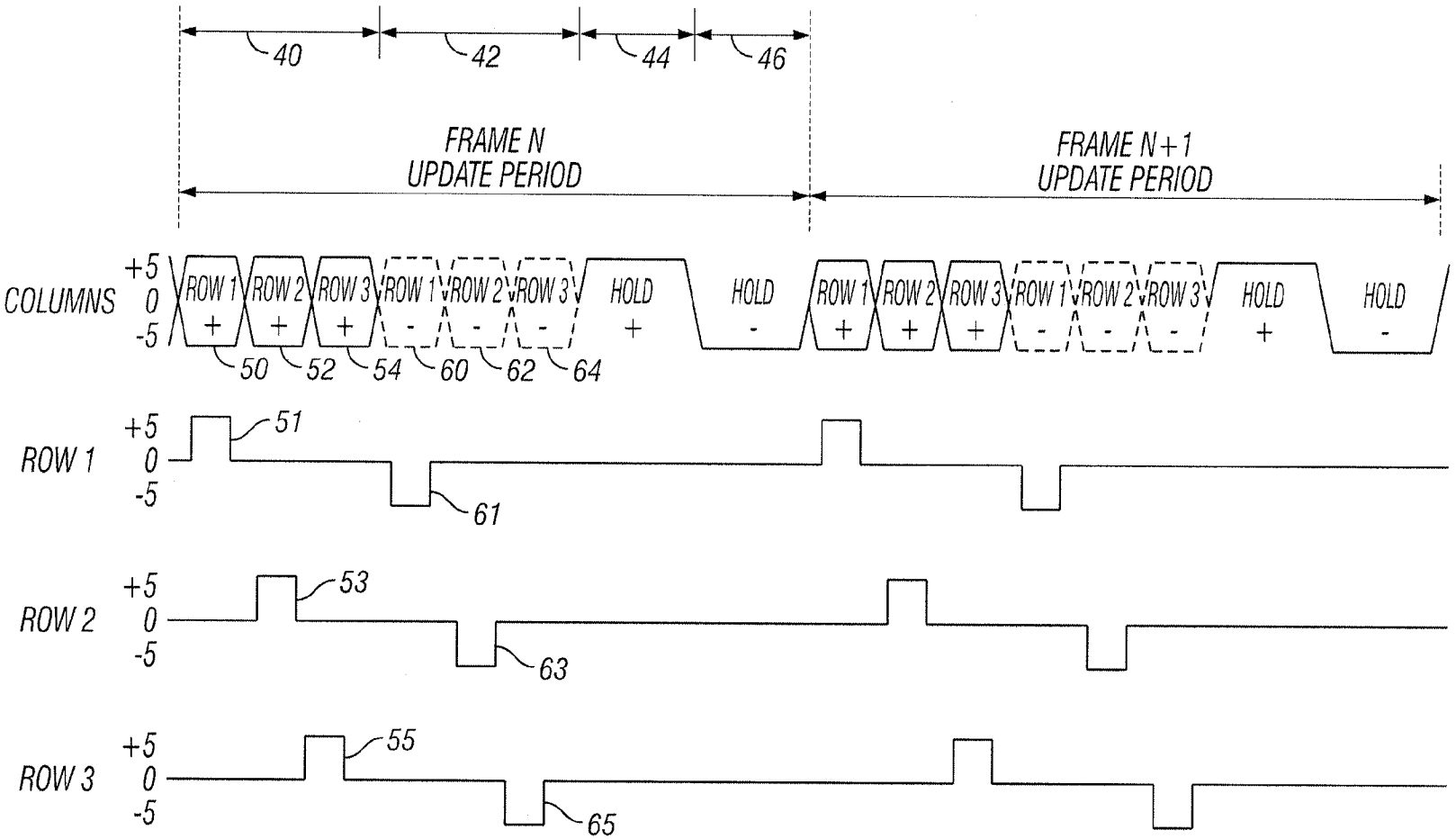
FIG. 8 is a timing diagram illustrating write and hold cycles during a frame update period in a first embodiment of the invention.

It is one feature of the display elements described herein that a frame of data can generally be written to the array of display elements in a time period shorter than the update period defined by the frame update rate. In the embodiment of FIG. 8, the frame update period is divided into four portions or intervals, designated 40, 42, 44, and 46 in FIG. 8. FIG. 8 illustrates a timing diagram for a 3 row display, such as illustrated in FIG. 5A.

During the first portion 40 of a frame update period, the frame is written with potential differences across the modulator elements of a first polarity. For example, the voltages applied to the rows and columns may follow the polarity illustrated by the center row of FIG. 4 and FIG. 5B. As with FIG. 7, in FIG. 8, the column voltages are not shown individually, but are indicated as a multi-conductor bus, where the column voltages are valid for row 1 data during period 50, are valid for row 2 data during period 52, and valid for row 3 data during period 54, wherein "valid" is a selected voltage which differs depending on the desired state of a display element in the column to be written. In the example of FIG. 5B, each column may assume a potential of +5 or −5 depending on the desired display element state. As explained above, row pulse 51 sets the state of row 1 display elements as desired, row pulse 53 sets the state of row 2 display elements as desired, and row pulse 55 sets the state of row 3 display elements as desired.

During a second portion 42 of the frame update period, the same data is written to the array with the opposite polarities applied to the display elements. During this period, the voltages present on the columns are the opposite of what they were during the first portion 40. If the voltage was, for example, +5 volts on a column during time period 50, it will be −5 volts during time period 60, and vice versa. The same is true for sequential applications of sets of display data to the columns, e.g., the potential during period 62 is opposite to that of 52, and the potential during period 64 is opposite to that applied during time period 54. Row strobes 61, 63, 65 of opposite polarity to those provided during the first portion 40 of the frame update period re-write the same data to the array during second portion 42 as was written during portion 40, but the polarity of the applied voltage across the display elements is reversed.

In the embodiment illustrated in FIG. 8, both the first period 40 and the second period 42 are complete before the end of the frame update period. In this embodiment, this time period is filled with a pair of alternating hold periods 44 and 46. Using the array of FIGS. 3-5 as an example, during the first hold period 44, the rows are all held at 0 volts, and the columns are all brought to +5 V. During the second hold period 46, the rows remain at 0 volts, and the columns are all brought to −5 V. Thus, during the period following array writing of Frame N, but before array writing of Frame N+1, bias potentials of opposite polarity are each applied to the elements of the array. During these periods, the state of the array elements does not change, but potentials of opposite polarity are applied to minimize charge buildup in the display elements.

Figure 9:
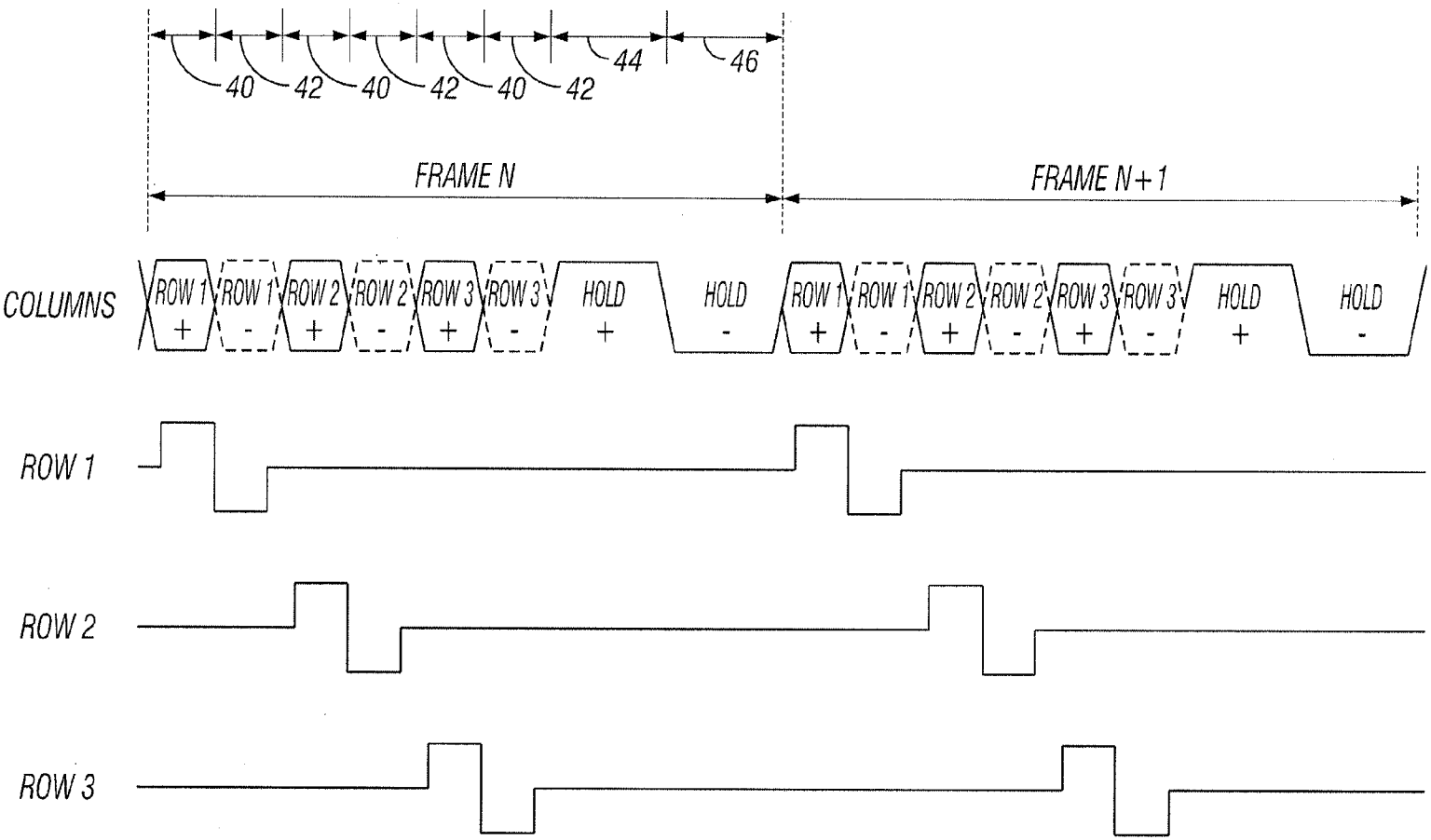
FIG. 9 is a timing diagram illustrating write and hold cycles during a frame update period in a first embodiment of the invention.

During the next frame update period for Frame N+1, the process may be repeated, as shown in FIG. 8. It will be appreciated that a variety of modifications of this overall method may be utilized to advantageous effect. For example, more than two hold periods could be provided. FIG. 9 illustrates an embodiment where the writing in opposite polarities is done on a row by row basis rather than a frame by frame basis. In this embodiment, the time periods 40 and 42 of FIG. 8 are interleaved. In addition, the modulator may be more susceptible to charging in one polarity than the other, and so although essentially exactly equal positive and negative write and hold times are usually most advantageous, it might be beneficial in some cases to skew the relative time periods of positive and negative polarity actuation and holding slightly. Thus, in one embodiment, the time of the write cycles and hold cycles can be adjusted so as to allow the charge to balance out. In an exemplary embodiment, using values selected purely for illustration and ease of arithmetic, an electrode material can have a rate of charging in positive polarity is twice as fast the rate of charging in the negative polarity. If the positive write cycle, write+, is 10 ms, the negative write cycle, write−, could be 20 ms to compensate. Thus the write+ cycle will take a third of the total write cycle, and the write− cycle will take two-thirds of the total write time. Similarly the hold cycles could have a similar time ratio. In other embodiments, the change in electric field could be non-linear, such that the rate of charge or discharge could vary over time. In this case, the cycle times could be adjusted based on the non-linear charge and discharge rates.

In some embodiments, several timing variables are independently programmable to ensure DC electric neutrality and consistent hysteresis windows. These timing settings include, but are not limited to, the write+ and write− cycle times, the positive hold and negative hold cycle times, and the row strobe time.

While the frame update cycles discussed herein have a set order of write+, write−, hold+, and hold−, this order can be changed. In other embodiments, the order of cycles can be any other permutation of the cycles. In still other embodiments, different cycles and different permutations of cycles can be used for different display update periods. For example, Frame N might include only a write+ cycle, hold+ cycle, and a hold− cycle, while subsequent Frame N+1 could include only a write−, hold+, and hold− cycle. Another embodiment could use write+, hold+, write−, hold− for one or a series of frames, and then use write−, hold−, write+, hold+ for the next subsequent one or series of frames. It will also be appreciated that the order of the positive and negative polarity hold cycles can be independently selected for each column. In this embodiment, some columns cycle through hold+ first, then hold−, while other columns go to hold− first and then to hold+. In one example, depending on the configuration of the column driver circuit, it may be more advantageous to set half the columns at −5 V and half at +5 V for the first hold cycle 44, and then switch all column polarities to set the first half to +5 V and the second half to −5 V for the second hold cycle 46.

It has also been found advantageous to periodically include a release cycle for the MEMS display elements. It is advantageous to perform this release cycle for one or more rows during some of the frame update cycles. This release cycle will typically be provided relatively infrequently, such as every 100,000 or 1,000,000 frame updates, or every hour or several hours of display operation. The purpose of this periodic releasing of all or substantially all pixels is to reduce the chance that a MEMS display element that is continually actuated for a long period due to the nature of the images being displayed will become stuck in an actuated state. In the embodiment of FIG. 8, for example, period 50 could be a write+ cycle that writes all the display elements of row 1 into a released state every 100,000 frame updates. The same may be done for all the rows of the display with periods 52, 54, and/or 60, 62, 64. Since they occur infrequently and for short periods, these release cycles may be widely spread in time (e.g. every 100,000 or more frame updates or every hour or more of display operation) and spread at different times over different rows of the display so as to eliminate any perceptible affect on visual appearance of the display to a normal observer.

Figure 10:
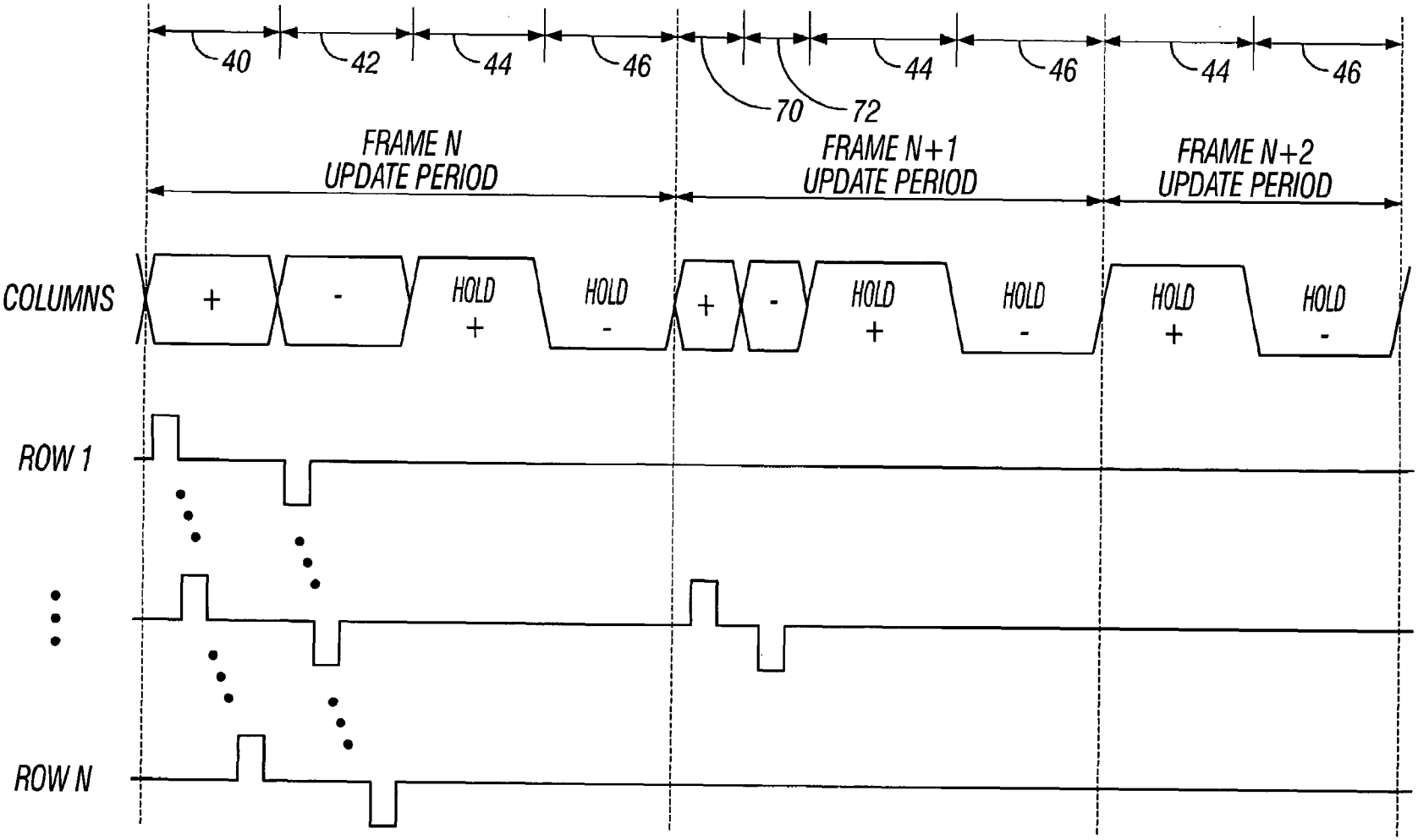
FIG. 10 is a timing diagram illustrating variable length write and hold cycles during frame update periods.

FIG. 10 shows another embodiment wherein frame writing may take a variable amount of the frame update period, and the hold cycle periods are adjusted in length in order fill the time between completion of the display write process for one frame and the beginning of the display write process for the subsequent frame. In this embodiment, the time to write a frame of data, e.g. periods 40 and 42, may vary depending on how different a frame of data is from the preceding frame. In FIG. 10, Frame N requires a complete frame write operation, wherein all the rows of the array are strobed. To do this in both polarities requires time periods 40 and 42 as illustrated in FIGS. 8 and 9. For Frame N+1, only some of the rows require updates because in this example, the image data is the same for some of the rows of the array. Rows that are unchanged (e.g. row 1 and row N of FIG. 10) are not strobed. Writing the new data to the array thus requires shorter periods 70 and 72 since only some of the rows need to be strobed. For Frame N+1, the hold cycles 44, 46 are extended to fill the remaining time before writing Frame N+2 is to begin. In this example, Frame N+2 is unchanged from Frame N+1. No write cycles are then needed, and the update period for Frame N+2 is completely filled with hold cycles 44 and 46. As described above, more than two hold cycles, e.g. four cycles, eight cycles, etc. could be used.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A method of actuating a MEMS display element, said MEMS display element comprising a portion of an array of MEMS display elements, said method comprising:

writing display data to said MEMS display element with a potential difference of a first polarity during a first portion of a display write process;

re-writing said display data to said MEMS display element with a potential difference having a polarity opposite said first polarity during a second portion of said display write process;

applying a first bias potential having said first polarity to said MEMS display element during a third portion of said display write process; and applying a second bias potential having said opposite polarity to said MEMS display element during a fourth portion of said display write process, wherein a state of said MEMS display element does not change during said third and fourth portions.

2. The method of claim 1, wherein said first portion of said display write process comprises writing a first frame of display data to said array of MEMS display elements, and wherein said second portion of said display write process comprises re-writing said first frame of display data to said array of MEMS display elements.

3. The method of claim 2, wherein said third and fourth portions of said display write process comprises holding said first frame of display data following said re-writing.

4. The method of claim 3, additionally comprising writing a second frame of display data using said writing, re-writing, applying a first bias potential and applying a second bias potential.

5. The method of claim 1, wherein said first portion of said display write process comprises writing a first row of display data to said array of MEMS display elements, and wherein said second portion of said display write process comprises re-writing said first row of display data to said array of MEMS display elements.

6. The method of claim 5, wherein said third and fourth portions of said display write process comprises holding said first row of display data following said re-writing.

7. The method of claim 6, additionally comprising writing a second row of display data using said writing, re-writing, applying a first bias potential and applying a second bias potential.

8. The method of claim 1, wherein said first, second, third, and fourth portions of said display write process each comprise approximately one-fourth of a time period defined by the inverse of a rate at which frames of display data are received by a display system.

9. The method of claim 1, wherein said first portion and said second portion together comprise less than ½ of a time period defined by the inverse of a rate at which frames of display data are received by a display system.

10. The method of claim 1, wherein said first portion extends for a first time period and said second portion extends for a second time period.

11. The method of claim 10, wherein said first and second time periods are different.

12. The method of claim 11, wherein said first and second time periods are determined based at least in part on a polarity dependent dielectric charging rate.

13. A method of maintaining a frame of display data on an array of MEMS display elements, said method comprising alternately applying approximately equal bias voltages of opposite polarities to each of said MEMS display elements for periods of time defined at least in part by the inverse of a rate at which frames of display data are received by a display system.

14. The method of claim 13, wherein each said period of time is substantially equal to 1/(2f), wherein f is a defined frequency of frame refresh cycles.

15. The method of claim 13, wherein each said period of time is substantially equal to 1/(4f), wherein f is a defined frequency of frame refresh cycles.

16. A method of writing frames of display data to an array of MEMS display elements at a rate of one frame per defined frame update period, said method comprising:

writing display data to said MEMS display elements, wherein said writing takes less than said frame update period; and applying a series of bias potentials of alternating polarity to said MEMS display elements for the remainder of said frame update period, wherein a state of said MEMS display elements does not change during said remainder.

17. The method of claim 16 wherein said series comprises an application of a first polarity during approximately half of said remainder of said frame update period, and an application of a second opposite polarity during approximately half of said frame update period.

18. A MEMS display device configured to display images at a frame update rate, said frame update rate defining a frame update period, said display device comprising a column driver circuit configured to apply a polarity balanced sequence of bias voltages to substantially all columns of a MEMS display array for portions of at least one frame update period, wherein a state of said MEMS display array does not change during said portions, and wherein said portions are defined by a time remaining between completing a frame write process for a first frame, and beginning a frame write process for a next subsequent frame.

19. The MEMS display device of claim 18, wherein said driver circuit is configured to apply the same voltage to substantially all columns of said display array during a portion of said frame update period.

20. A method of driving a MEMS display comprising periodically releasing substantially all pixels of said display, wherein said periodic releasing occurs for each pixel at an infrequent rate such that there is no perceptible effect on visual appearance of the display to a normal observer.

21. The method of claim 20, wherein any given periodically released pixel is released at a rate slower than once per hour of display use.

22. The method of claim 20, wherein any given periodically released pixel is released at a rate slower than once per 100,000 displayed frames of image data.

* * * * *

UNITED STATES PATENT AND TRADEMARK OFFICE

CERTIFICATE OF CORRECTION

PATENT NO. : 7,602,375 B2
APPLICATION NO. : 11/100762
DATED : October 13, 2009
INVENTOR(S) : Chui et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1109 days.

Signed and Sealed this

Fifth Day of October, 2010

David J. Kappos

David J. Kappos
*Director of the United States Patent and Trademark Office*